United States Patent [19]

Yano et al.

[11] Patent Number: 5,003,877

[45] Date of Patent: Apr. 2, 1991

[54] PRINTING APPARATUS INKER WITH END DAMS

[75] Inventors: Tadashi Yano; Kenichi Hamada, both of Mihara, Japan

[73] Assignee: Mitsubishi Jukogyo Kabushiki Kaisha, Tokyo, Japan

[21] Appl. No.: 338,318

[22] Filed: Apr. 17, 1989

[30] Foreign Application Priority Data

Apr. 18, 1988 [JP] Japan ..... 63-50851[U]

[51] Int. Cl.[5] ..... B41F 31/20; B41F 35/04; B41L 27/22; B41L 41/04

[52] U.S. Cl. ..... 101/363; 101/425

[58] Field of Search ..... 101/349, 363, 350, 351, 101/352, 364, 207-210, 425, 424

[56] References Cited

U.S. PATENT DOCUMENTS

| | | | |
|---|---|---|---|
| 2,887,050 | 5/1959 | Moser et al. . | |
| 3,896,730 | 7/1975 | Garrett | 101/364 |
| 4,165,688 | 8/1979 | Leanna et al. | 101/207 |
| 4,426,412 | 1/1984 | Gebert et al. | 118/410 X |
| 4,480,548 | 11/1984 | Bebel et al. | 101/364 |
| 4,526,102 | 7/1985 | Grobman | 101/425 |
| 4,534,291 | 8/1985 | Sabota et al. | 101/426 |

FOREIGN PATENT DOCUMENTS

| | | |
|---|---|---|
| 58-142852 | 8/1983 | Japan . |
| 60-139452 | 7/1985 | Japan . |

*Primary Examiner*—J. Reed Fisher

*Attorney, Agent, or Firm*—Rothwell, Figg, Ernst & Kurz

[57] ABSTRACT

A printing apparatus comprising: a pair of ink rolls (1, 17) defining a nip (2) therebetween; a pair of dams (3, 3') provided in the nip and movable in the direction of the axes of the ink rolls; an ink supplying device having an ink pump (11) for supplying an ink (18) to the segment of said nip located between the dams; an ink recovery device for recovering excess quantities of the ink supplied to said nip; a washing liquid supplying device for supplying a washing liquid (22) to said ink supplying device and to said ink recovering device via said nip; and a lubricant supplying device for supplying a lubricating liquid (8) to the segments of said nip located outside said dams. In printing, the segment of the nip of the ink rolls (1, 17) between the dams (3, 3') is lubricated with the ink film and the segments of the nip of the ink rolls (1, 7) outside the dams are lubricated with the lubricating liquid. The ink or washing liquid remaining in the nip or in the ink circulation path can be forcibly and rapidly recovered and therefore the productive efficiency can be improved. Further, since the ink in the circulation path can be forcibly recovered, the ink will not be present in the ink circulation path when the next order ink is to be circulated in the path, and therefore the problem of the degradation of printing quality due to mixing of one ink and the next order ink in the circulation path can be avoided.

3 Claims, 3 Drawing Sheets

PRINTING APPARATUS INKER WITH END DAMS

FIELD OF THE INVENTION

The present invention relates to a printing apparatus for printing a sheet such as corrugated fiberboard sheet.

BACKGROUND OF THE INVENTION

A prior art printing apparatus shown in FIG. 4 comprises an anilox roll (ink roll) 1; a rubber roll (another ink roll) 17; a nip 2 formed between the anilox roll 1 and the rubber roll 17; an ink pump 11; an ink supply duct 12; ink discharge ducts 13 and 13'; ink reservoirs 14*a* and 14*b*; ink supply ports 15 formed in the ink reservoirs 14*a* and 14*b* for connection to said ink supply duct 12; ink recovery ports 16 formed in the ink reservoirs 14*a* and 14*b* for connection to said ink discharge duct 14; a flexo ink 18 contained in said ink reservoirs 14*a* and 14*b*; end pans (ink sumps) 19 and 19' provided beneath the opposite ends of said anilox roll 1 and said rubber roll 17; a bucket 20; an electromagnetic valve 21 of a washing device; and a washing liquid 22. The flexo ink 18 is supplied from the ink reservoir 14*a* to the nip 2 between the anilox roll 1 and the rubber roll 17 through the ink supply port 15, through the ink supply duct 12, through the ink pump 11, and then again through the ink supply duct 12, as indicated by solid line arrows in the figure. The flexo ink 18 supplied to the nip 2 is doctored by the rubber roll 17 and is homogeneously transferred to the surface of the anilox roll 1 and is then further transferred to the printing plate of a printing cylinder (not shown). A corrugated fiberboard sheet is brought into contact with the printing plate of the printing cylinder, whereby the sheet is printed. During such printing process, the flexo ink 18 is continuously supplied to the nip 2. Excess quantities of the flexo ink 18 will overflow both ends of the nip 2, flowing down into the end pans (ink sumps) 19 and 19'. The ink is then returned to the ink reservoir 14*a* through the ink discharge ducts 13' and 13 and through the ink recovery port 16. The flexo ink 18 contained in the ink reservoir 14*a* is continuously supplied to the nip 2 between the anilox roll 1 and the rubber roll 17 via the above indicated path while said corrugated fiberboard sheet is printed.

The ink can be replaced by other inks for meeting order changes, for example, in a manner as follows: First, the ink pump 11 is deactivated to stop the flow of the flexo ink 18 through said ink circulating path. An exchanger mechanism (not shown) is then actuated in order to remove the lower ends of the ink supply duct 12 and of the ink discharge duct 13 from, and then position them immediately above, the ink supply port 15 and the ink recovery port 16, respectively, of the ink reservoir 14*a*. Such positioning is maintained until a preset time set in a timer (not shown) elapses. In the meantime, the quantities of the flexo ink 18 remaining in the nip 2 or in the ink circulating path is allowed to flow down into the ink reservoir 14*a* under the influence of the gravity, whereby the ink can be recovered. After the preset time set in the timer has elapsed and the remaining quantities of the flexo ink 18 in the nip 2 and in the ink circulating path have been collected in the ink reservoir 14*a*, the timer will give an ink recovery completion signal to the exchanger mechanism. In response to the signal, the mechanism will operate such as to move the lower ends of the ink supply duct 12 and of the ink discharge duct 13 to their respective predetermined positions over the bucket 20. Then, the electromagnetic valve 21 of the ink washing device is opened to allow the washing liquid 22 to flow through the electromagnetic valve 21 toward the section of the ink supply duct 12 where the ink pump 11 is located, on the one hand, and toward the ink reservoir 14*a* through another section of the ink supply duct 12 which extends toward the nip 2, through the nip 2, through the end pans (ink sumps) 19 and 19', through the ink discharge ducts 13 and 13', on the other hand, as indicated by broken line arrows, whereby the nip 2 and the ink circulating path are washed, and the used washing liquid 22 is collected in the bucket 20. Upon the lapse of a predetermined time, the electromagnetic valve 21 is closed to stop the supply of the washing liquid 22. The conditions are maintained until a preset time set in the timer elapses; meanwhile, the remaining quantities of the washing liquid 22 in the nip 2 and in the ink circulating path are allowed to flow down into the bucket 20 under the influence of the gravity. When the preset time set in the timer has elapsed and the remaining quantities of the washing liquid 22 in the nip 2 and in the ink circulating path have been discharged into the bucket 20, the timer will give a washing liquid recovery completion signal to the exchanger mechanism. In response to the signal, the exchanger is actuated such as to connect the lower ends of the ink supply duct 12 and of the ink discharge duct 13 to the ink supply port 15 and the ink recovery port 16, respectively, of another ink reservoir 14*b* containing therein the next order flexo ink 18. Then, the ink pump 11 is actuated to supply the flexo ink 18 from the ink reservoir 14*b* to the nip 2 between the anilox roll 1 and the rubber roll 17 through the ink supply port 15, through ink supply duct 12, through the ink pump 11, and the again through the ink supply duct 12.

In the prior art printing apparatus shown in FIG. 4, the flexo ink 18 or washing liquid 22 remaining in the nip 2 or in the ink circulating path is recovered by their spontaneous flowing down movement. It thus takes a relatively long time to recover the flexo ink 18 or the washing liquid 22; this is a cause of low productive efficiency. Further, small quantities of flexo inks 18 will always inevitably remain in the nip 2 and in the ink circulating path even after the spontaneous flowing down since flexo inks are viscous, and such remaining inks will consequently be mixed with the next order flexo ink 18, causing a problem of deteriorating the quality of the print.

SUMMARY OF THE INVENTION

The present invention has been proposed in view of the foregoing problems.

An object of the present invention is therefore to provide a printing apparatus which can achieve a high productive efficiency, can avoid the above-mentioned problem of deteriorating the quality of the print, can operate with a reduced circulating rate of ink and with a reduced supply of washing liquid, and can have a reduced loss of ink which cannot be recovered.

To achieve the object, the present invention provides a printing apparatus comprising:

- a pair of ink rolls defining a nip therebetween;
- a pair of dams provided in the nip and movable in the direction of the axes of the ink rolls;
- an ink supplying device having an ink pump for supplying an ink to the segment of said nip located between the dams;

an ink recovery device for recovering excess quantities of the ink supplied to said nip;

a washing liquid supplying device for supplying a washing liquid to said ink supplying device and to said ink recovering device via said nip; and a lubricant supplying device for supplying a lubricating liquid to the segments of said nip located outside said dams.

In the printing apparatus according to the present invention, having an arrangement as defined above, an ink is supplied to the nip between the dams by the ink pump of the ink supplying device during printing, while excess quantities of the ink supplied to the nip between the dams are recovered by the recovering pump of the ink recovering device. Then, a thin ink film is formed in the nip segment located between the dams, which thin ink film lubricates the segment of each ink roll located between the dams while, on the other hand, a lubricating liquid such as water is supplied to the nip segments located outside the dams, which lubricating liquid lubricates the ink roll segments located outside the dams, whereby abrasion of each ink roll can be avoided in each segment thereof along the overall length thereof. When the ink is to be replaced by another ink, the quantities of the ink remaining in the nip between the dams are forcibly recovered by the recovering pump of the ink recovering device. Subsequently, the washing liquid supplying device will wash the ink supplying device by supplying a washing liquid to the ink supplying device and the nip, and at the same time said recovering pump will, via the ink recovering device, recover the washing liquid which has been supplied to said nip, thereby washing the ink recovering device. After the washing of the ink supplying device and of the ink recovering device has been completed, the next order ink is supplied to the nip between the dams by the ink pump of the ink supplying device and excess quantities of the ink supplied to the nip between the dams are recovered by the recovering pump of the ink recovering device, so that subsequent printing operations can be performed.

BRIEF DESCRIPTION OF THE DRAWINGS

The present invention will now be described, by way of example, with reference to the accompanying drawings, in which.

DESCRIPTION OF A PREFERRED EMBODIMENT

Figure 1:
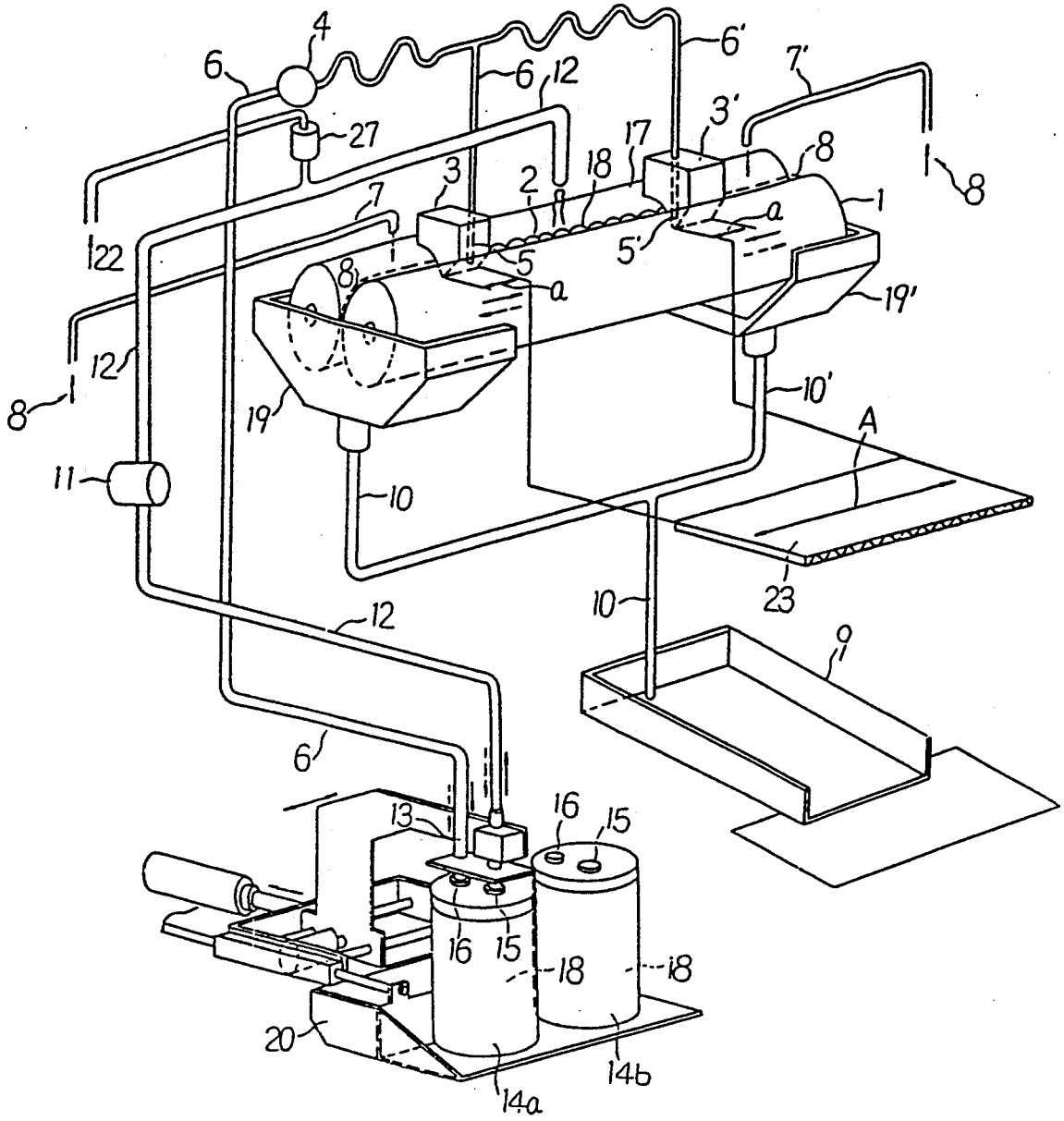
FIG. 1 is a perspective view showing an embodiment of the printing apparatus according to the present invention.
Figure 2:
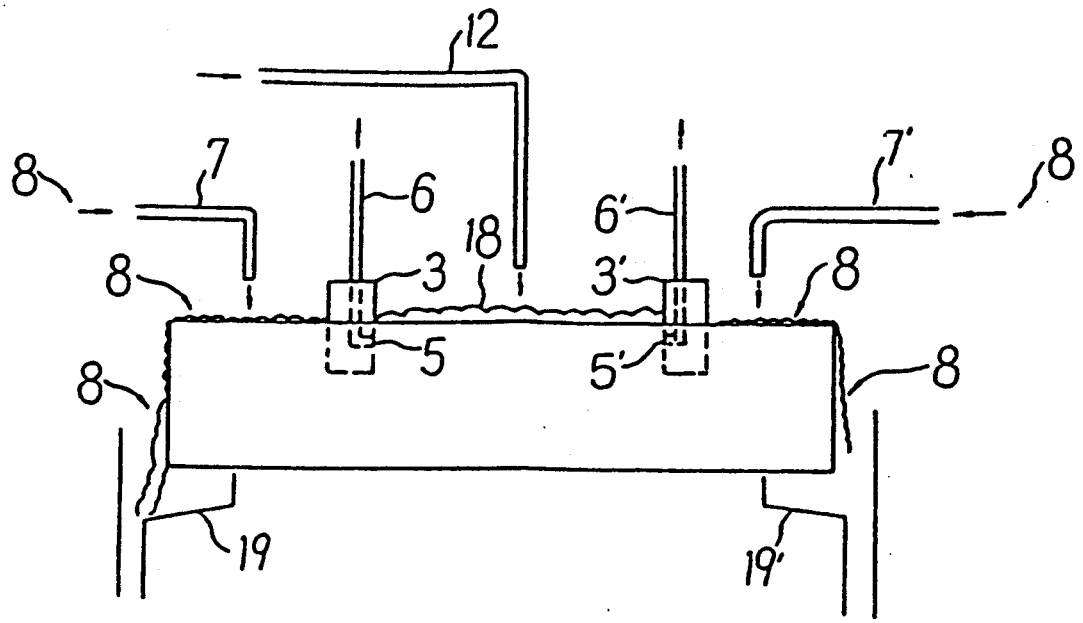
FIG. 2 is a side elevational view showing ink rolls of the apparatus.

An embodiment of the printing apparatus according to the present invention, shown in FIGS. 1 and 2, comprises: an anilox roll (ink roll) 1; a rubber roll (another ink roll) 17; a nip 2 formed between the anilox roll 1 and the rubber roll 17; a pair of dams 3 and 3' movable in said nip 2 in the direction of the axes of the ink rolls over a range which depends upon the printing width A of a corrugated fiberboard sheet 23; an ink recovering device including a recovering pump 4 for recovering excess quantities of a flexo ink 18 supplied to the nip segment 2 located between the dams 3 and 3'; suction ports 5 and 5' provided in said dams 3 and 3', respectively; ink recovering ducts 6 and 6' belonging to the ink recovering device and connected to the suction ports 5 and 5'; a lubricant supplying device including lubricant supplying ducts 7 and 7' for supplying a lubricating liquid 8 to the segments of said nip 2 located outside the dams 3 and 3'; a lubricant discharge channel 9; lubricant discharge ducts 10 and 10'; an ink supplying device including an ink pump 11; an ink supply duct 12; ink reservoirs 14*a* and 14*b*; ink supply ports 15, 15 formed in the ink reservoirs 14*a* and 14*b* for connection to said ink supply duct 12; ink recovery ports 16, 16 formed in the ink reservoirs 14*a* and 14*b* for connection to said ink recovery duct 6; a flexo ink 18 contained in the ink reservoirs 14*a* and 14*b*; end pans or ink sumps 19 and 19' provided beneath the opposite ends of the Anilox roll 1 and the rubber roll 17; a bucket 20; a washing device including an electromagnetic valve 21; and a washing liquid 22.

Figure 3:
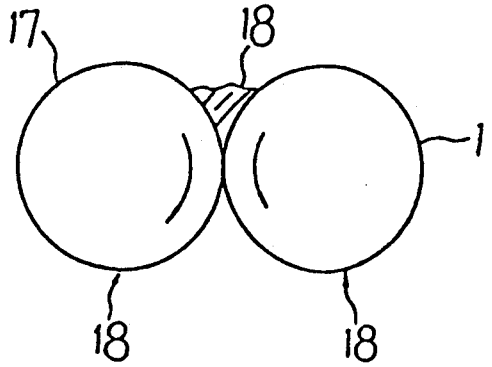
FIG. 3 is a front elevational view showing the ink rolls.
Figure 4:
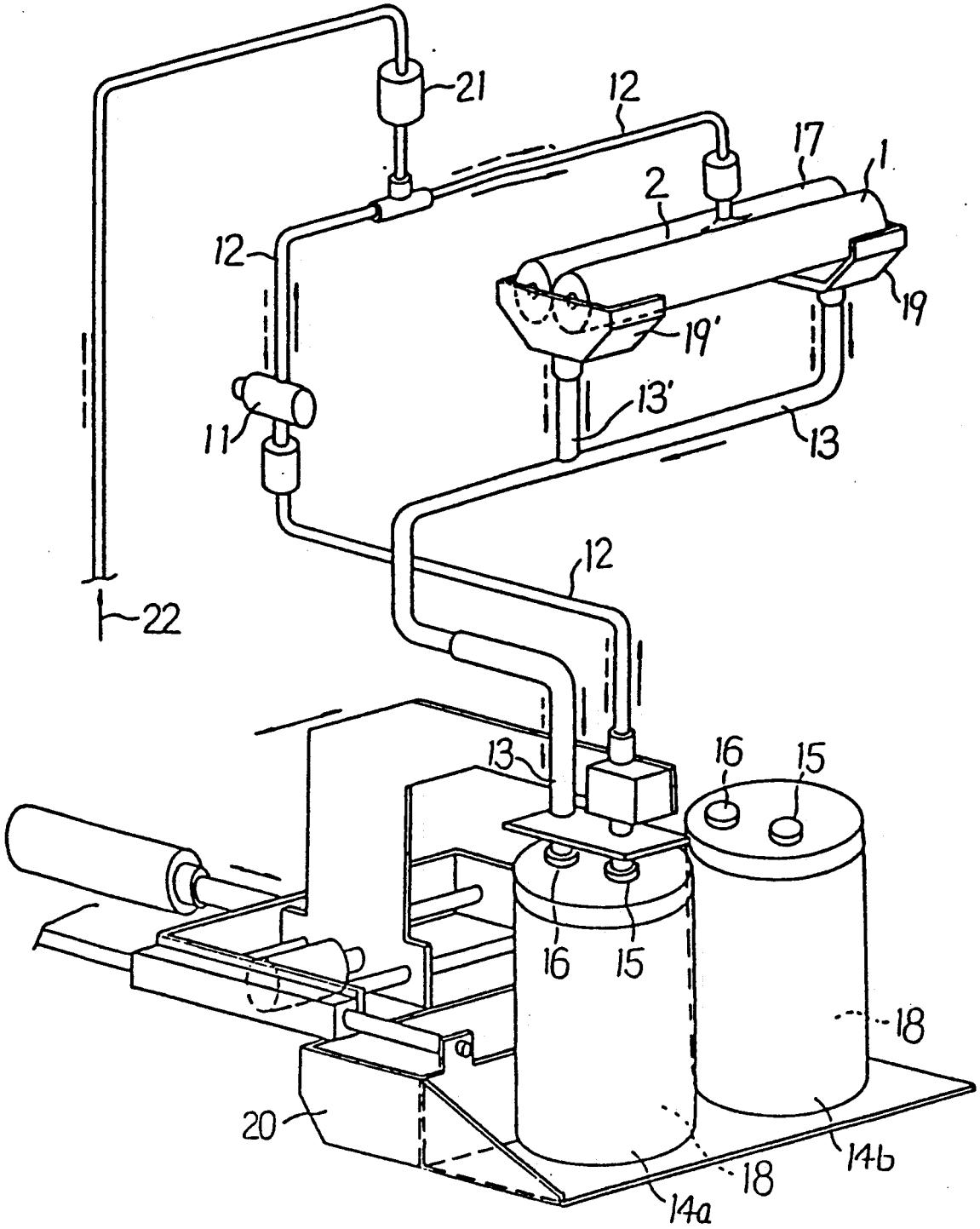
FIG. 4 PRIOR ART
FIG. 4 is a perspective view showing a prior art printing apparatus.

The operation of the printing apparatus shown in FIGS. 1 and 2 will be described. The flexo ink 18 contained in the ink reservoir 14*a* is supplied to the nip 2 between the anilox roll 1 and the rubber roll 17 through the ink supply duct 12, through the ink pump 11, and again through the ink supply duct 12, as indicated by solid line arrows. The flexo ink 18 supplied to the nip 2 is doctored by the rubber roll 17, is then homogeneously transferred to the surface of the anilox roll 1, and is next transferred to the print surface of a printing cylinder (not shown). A predetermined printing operation is performed by bringing a corrugated fiberboard sheet into contact with the printing plate of the printing cylinder. During such printing process, the flexo ink 18 is continuously or intermittently supplied to the nip 2 and is deposited between the dams 3 and 3'. The dams 3 and 3' are movable in the axial direction of the ink rolls, depending on the printed width of the corrugated fiberboard sheet. The flexo ink 18 supplied to the nip 2 will spontaneously move from the intermediate region along the length of the ink rolls toward the dams 3 and 3', with the result that excess quantities of the flexo ink 18 will return to the ink reservoir 14*a* through the suction ports 5 and 5' formed in the dams 3 and 3', respectively, through ink recovery ducts 6 and 6', through the pump 4, through the ink recovery duct 6 and through the ink recovery port 16. The anilox roll 1 and the rubber roll 17 are pressed against each other with a predetermined pressure along their full axial length, while rotating in the respective directions indicated by arrows in FIG. 3 at their respective circumferential speeds which are independent from each other. In the prior art printing apparatus, the flexo ink 18 supplied to between the anilox roll 1 and the rubber roll 17 from above will form a thin ink film after passing through the nip 2, as shown in FIG. 3, the thin ink film serving to lubricate the nip 2 along its full axial length, thereby preventing the abrasion of the anilox roll 1 and the rubber roll 17. In contrast, in the embodiment shown, the abrasion of the anilox roll 1 and the rubber roll 17 is prevented by lubricating the segment of the nip 2 located between the dams 3 and 3' with the thin ink film, while lubricating the nip segments located outside the dams 3 and 3' with a lubricating liquid 8. Specifically, the segment of the nip 2 between the dams 3 and 3' is lubricated with the thin ink film, while the segments of the nip 2 outside the dams 3 and 3' are lubricated with a lubricating liquid 8 such as, for example, water, which is continuously or intermittently supplied thereto through the lubricant supply ducts 7 and 7' of the lubricant supplying device.

The lubricating liquid 8 will overflow the nip 2 between the anilox roll 1 and the rubber roll 17 at the opposite ends and will flow down into the end pans or oil sumps 19 and 19'. The liquid will then flow from the end pans 19 and 19' onto the lubricant discharge channel 9 through the lubricant discharge ducts 10 and 10'. The nip segments outside the dams 3 and 3' are thus lubricated with the liquid 8, whereby the anilox roll 1 and the rubber roll 17 are protected from abrasion. A pump (not shown) may be provided in the lubricant discharge channel 9 for circulating the lubricating liquid 8 back to the nip 2, thereby repeatedly using the lubricating liquid. As described, the nip segment between the dams 3 and 3' is lubricated with the ink film, while the nip segments outside the dams 3 and 3' are lubricated with the lubricating liquid 8. Then, the boundaries between the ink film and the lubricating liquid 8 should be lubricated. Thus, the dams 3 and 3' are continuously or intermittently reciprocated by a distance substantially corresponding to their width (a), so that the boundaries between the ink film and the lubricating liquid 8 can also be lubricated. Known motors (such as electric motors, pneumatic motors or hydraulic motors) may be used as means for moving the dams 3 and 3'. Known position sensors (such as pulse generators, or limit switches) may be used as means for positioning the dams. Known controllers serving to control such known motors and sensors may be used as means for timing the dams to move.

The ink may be replaced by another in accordance with an order change or the like in a manner as follows: First, the ink pump 11 is stopped to interrupt the flow of the flexo ink 18 circulating the ink circulation path. Next, an exchanger mechanism (not shown) is actuated to remove the lower ends of the ink supply duct 12 and of the ink recovery duct 16 from, and to place them immediately above the ink supply port 15 and the ink recovery port 16, respectively, of the ink reservoir 14*a*. Such positioning is maintained until a preset time set in a timer (not shown) elapses. In the meantime, the quantities of the flexo ink 18 still remaining in the nip 2 between the dams 3 and 3' or in the ink circulation path are forcibly recovered or collected by the still operating recovery pump 4 into the ink reservoir 14*a* through the suction ports 5 and 5', through the ink recovery ducts 6 and 6', through the recovery pump (drawing pump) 4, and then through the ink recovery duct 6. At this time, to improve the ink recovery efficiency, the dams 3 and 3' may be moved toward each other as shown by solid line arrow in FIG. 1, thereby scraping up the flexo ink 18 in the nip 2. Within the present time set in the timer, the quantities of the flexo ink 18 contained in the ink supply duct 12 and in the ink pump 11 are allowed to flow down into the ink reservoir 14*a* under the influence of the gravity. When the present time set in the timer has elapsed and the flexo ink 18 in the nip 2 and the ink circulation path has been collected into the ink reservoir 14*a*, the timer will give an ink recovery completion signal to the exchanger mechanism. In response to the signal, the mechanism is actuated to place the lower ends of the ink supply duct 12 and of the ink recovery duct 6 in the predetermined positions over the bucket 20. Next, the dams 3 and 3' are moved away form each other, transversely to the corrugated fiberboard sheet 23, as indicated by broken line arrows in FIG. 1, to their respective predetermined positions. Subsequently, the electromagnetic valve 21 of the ink washing device is opened to allow the washing liquid 22 to flow through the electromagnetic valve 21 to the segment of the ink supply duct 12 where the ink pump 11 is provided, on the one hand, and through the segment of the ink supply duct 12 which extends toward the nip 2, through the nip 2, through the suction ports 5 and 5' of the dams 3 and 3', respectively, through the ink recovery ducts 6 and 6', through the still operating recovery pump 4, and then through the recovery duct 6, on the other hand, whereby the nip 2 and the ink circulation path are washed and the used washing liquid 22 is discharged into the bucket 20. After the lapse of a predetermined time, the electromagnetic valve 21 is closed to stop the supply of the washing liquid 22. Under such conditions, the quantities of the washing liquid 22 remaining in the ink circulation path are allowed to flow down into the bucket 20 for discharge until after the lapse of the preset time set in the timer. When the preset time set in the timer has elapsed and the washing liquid 22 has been discharged into the bucket 20, the exchanger mechanism is actuated in response to a washing liquid recovery completion signal to connect the lower ends of the ink supply duct 12 and of the ink recovery duct 6 to the ink supply port 15 and the ink recovery port 16, respectively, of another ink reservoir 14*b* in which the next order flexo ink 18 is stored. Subsequently, the ink pump 11 is activated to supply the flexo ink 18 from the ink reservoir 14*b* to the nip 2 between the anilox roll 1 and the rubber roll 17 through the ink supply port 15, through the ink supply duct 12, through the ink pump 11, and then again through the ink supply duct 12, as indicated by solid line arrows. During the ink exchanging process, the dams 3 and 3' may be fixed.

As described, in the printing apparatus according to the present invention, during printing, the ink is supplied to the nip segment between the dams by the ink pump of the ink supplying device, and excess quantities of the ink supplied to the nip segment between the dams are recovered by the recovering pump of the ink recovering device. Then, the segment of the nip located between the ink rolls and between the dams is lubricated with an ink film formed therein, while a lubricating liquid such as, for example, water, is supplied by the lubricating liquid supplying device to the segments of the nip located outside the dams so that the outer nip segments can be lubricated with the lubricating liquid, whereby each of the ink rolls can be protected from abrasion throughout its axial length. When the ink is replaced by another, the quantities of the ink remaining in the nip segment between the dams are forcibly recovered by the recovering pump of the ink recovering device. Subsequently, the ink supplying device is washed by the washing liquid supplied to the ink supplying device and to the nip by the washing liquid supplying device, while the ink recovering device is washed by recovering the washing liquid from the nip through the ink recovering device. After the ink supplying device and the ink recovering device have been washed, next printing operations are performed by supplying the next order ink to the nip segment between the dams by means of the ink pump of the ink supplying device, while recovering excess quantities of the ink supplied to the nip segment by the recovering pump of the ink recovering device. Thus, the ink or washing liquid remaining in the nip or in the ink circulation path (the ink supplying device and the ink recovering device) can be forcibly and rapidly recovered and therefore the productive efficiency can be improved. Since the ink in the ink circulation path is forcibly recovered, the ink will not be present in the ink circulation path when the next order ink is to be circulated in the path, and therefore the problem of the degradation of printing quality due to mixing of one ink and the next order ink in the ink circulation path can be avoided. Further, the amounts of the ink and of the washing liquid to be supplied can be reduced, since they are supplied only to the nip segment located between the dams. Further, unlike the prior art device, the printing device according to the invention does not necessitate the operation of recovering the ink through the end pans and through the ink discharge duct; this means that a loss of ink due to its sticking to the inner walls of them, which could not be recovered heretofore, can be avoided. Further, since each of the dam can be positioned depending on the necessitated printed width, another loss of ink due to its sticking to the ink roll surfaces, which could not be recovered heretofore, can be reduced.

What is claimed is:

1. A printing apparatus comprising:

a pair of ink rolls defining a nip therebetween;

a pair of dams provided in the nip and movable in the direction of the axes of the ink rolls;

said pair of dams defining a segment of said nip located between the dams and defining segments of said nip located outside said dams;

an ink supplying device having an ink pump for supplying an ink to the segment of said nip located between the dams;

an ink recovery device comprising suction means for recovering excess quantities of the ink supplied to said segment of said nip located between said dams;

a washing liquid supplying device for supplying a washing liquid to said ink supplying device and to said ink recovering device via said nip; and a lubricant supplying device for supplying a lubricating liquid to the segments of said nip located outside said dams.

2. A printing apparatus as set forth in claim 1 wherein said suction means comprises at least one suction portion positioned in the vicinity of at least one of said pair of dams.

3. A printing apparatus as set forth in claim 2 wherein said suction means comprises at least one suction port positioned in the vicinity of each of said pair of dams.

* * * * *